United States Patent [19]

Boyko et al.

[11] Patent Number: 4,842,313

[45] Date of Patent: Jun. 27, 1989

[54] AUTOMATIC VEHICLE STRIKER POWERED BY A UNIDIRECTIONAL MOTOR

[75] Inventors: James G. Boyko; Timothy J. Farrar, both of Gorham, Me.

[73] Assignee: Masco Industries, Inc., Taylor, Mich.

[21] Appl. No.: 119,824

[22] Filed: Nov. 12, 1987

[51] Int. Cl.[4] ..... E05B 15/02

[52] U.S. Cl. ..... 292/341.16; 292/198; 292/DIG. 23; 296/155

[58] Field of Search ..... 292/341.16, 341.17, 292/341.15, 198, 201, 216, DIG. 23; 296/155, 148, 146

[56] References Cited

U.S. PATENT DOCUMENTS

| | | | |
|---|---|---|---|
| 2,039,433 | 5/1936 | Neill | 292/341.16 |
| 2,833,536 | 5/1958 | Joachim et al. | 49/280 |
| 2,896,990 | 7/1959 | Garvey et al. | 292/201 |
| 2,903,288 | 9/1959 | Joachim et al. | 292/341.16 |
| 3,081,078 | 3/1963 | Lohr | 292/58 X |
| 3,622,188 | 11/1971 | Goeman | 292/336.3 X |
| 3,835,678 | 9/1974 | Meyer et al. | 292/341.16 X |
| 4,225,166 | 9/1980 | Tanaka et al. | 292/341.17 |
| 4,333,269 | 6/1982 | Bascou | 49/280 |
| 4,530,185 | 7/1985 | Moriya et al. | 49/280 |
| 4,617,757 | 10/1986 | Kagiyama et al. | 49/280 |
| 4,667,990 | 5/1987 | Quantz | 292/216 X |
| 4,707,007 | 11/1987 | Inoh | 292/341.16 |

*Primary Examiner*—Lloyd A. Gall
*Assistant Examiner*—Curtis B. Brueske
*Attorney, Agent, or Firm*—Lerner, David, Littenbereg, Krumholz & Mentlik

[57] ABSTRACT

A final closing device for a closure member on a vehicle is disclosed. The closure member, which may be swingably, slidably or otherwise mounted for movement between open and closed positions on a vehicle body member, includes a latch bolt movable between latched and unlatched positions. The final closing device includes a striker support plate mounted on the body member for rotational movement about an axis perpendicular to such plate, a striker carried by the striker support plate and projecting therefrom at a position eccentrically offset from the axis, means carried by the body member and connected to the striker support plate for rotating the striker support plate, and means coupled to the rotating means and constructed and arranged to preclude reverse rotation of the striker plate for preventing unintended opening of the closure member when high opening forces are applied thereto. The striker is movable between extended and retracted positions upon unidirectional rotation of the striker support plate so that when the striker is engaged by the latch bolt and the striker support plate is rotated, the closure member is moved between a partially open position, away from the body member, and a fully closed position, in sealing engagement therewith.

10 Claims, 6 Drawing Sheets

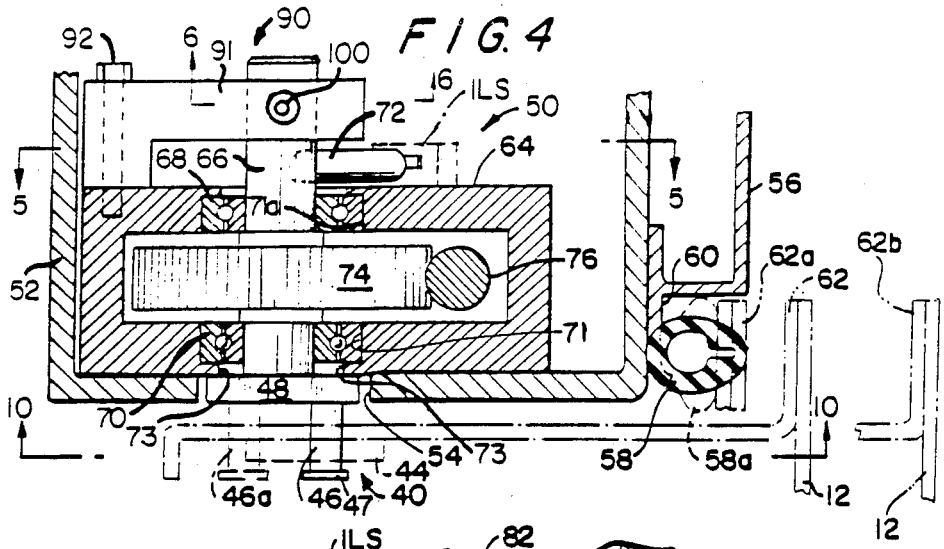
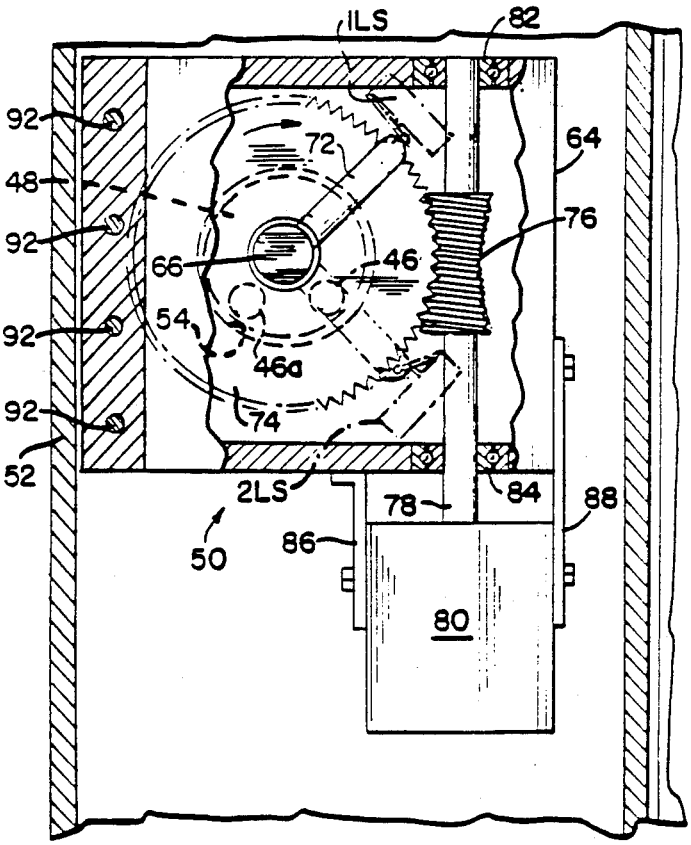
FIG. 5

AUTOMATIC VEHICLE STRIKER POWERED BY A UNIDIRECTIONAL MOTOR

BACKGROUND OF THE INVENTION

This invention relates to a final closing device for a closure member on a vehicle body and, more particularly, to a device for moving a vehicle-mounted closure member (e.g., a sliding door, a hinged door, a trunk lid, or the like) from a nearly closed position, at which a latch bolt engages a striker, to a fully closed position, at which the closure member is sealingly engaged with the vehicle body.

Vehicle closure members, whether hingedly connected to the vehicle body or slidingly mounted thereon, typically require only small forces to move them through the major extent of their opening and closing movement relative to the vehicle body. It is generally only during the final closing movement of the closure member, at which time the closure member must compress a weather seal strip carried by the vehicle body, that a large application of force must be applied to the closure member. However, in order to overcome the large resistance encountered in the final closing movement, vehicle closure members which are manually closed are typically moved with great momentum through their closing movement in order to insure that they will fully compress the weather seal strip at the end of such movement. Such high momentum movement of the closure members presents a significant safety problem with respect to vehicle occupants, who may inadvertently have failed to remove portions of their body from the path of movement of the closure member.

Various attempts have been made to mechanize the final closing movement of closure members. Such attempts have been made with respect to closure members that are manually moved through their initial, major range of movement (to the start of their final closing movement) and with respect to closure members which are automatically moved by powered devices through their initial major range of movement to that starting point. Examples of the former (manual preliminary movement) may be seen in U.S. Pat. Nos. 2,833,536, to Joachim et al and 2,896,990 to Garvey et al. Examples of the latter (powered preliminary movement) may be seen in U.S. Pat. Nos. 3,081,078 to Lohr, 4,333,269 to Bascou, and 4,530,185 to Moriya et al.

The final closing systems employed in the foregoing examples are generally costly, complicated mechanisms which are difficult to install and are subject to frequent breakdowns with attendant costly repairs. Moreover, it would be difficult, at best, to retrofit such mechanisms to vehicles not originally designed to receive them.

An improved final closing device for closure members of vehicles, which device overcomes many of the problems and deficiencies associated with the foregoing final closing systems, has been shown and also described in the copending application of James G. Boyko, U.S. Ser. No. 100,940, filed Sept. 25, 1987, which application is assigned to the assignee of the present application. In said copending application a final closing device for a closure member on a vehicle is disclosed. The closure member, which may be swingably, slidably or otherwise mounted for movement between open and closed positions on a vehicle body member, includes a latch bolt movable between latched and unlatched positions and a handle or a lock member movable between open and closed positions. The final closing device includes a striker support plate mounted on the body member for rotational movement about an axis perpendicular to such plate, a striker carried by the striker support plate and projecting therefrom at a position eccentrically offset from the axis, and means carried by the body member and connected to the striker support plate for rotating the striker support plate. The striker is movable between extended and retracted positions upon rotation of the striker support plate so that when the striker is engaged by the latch bolt and the striker support plate is rotated, the closure member is moved between a partially open position, away from the body member, and a fully closed position, in sealing engagement therewith.

Typical door latch and striker assemblies, including the one shown and described in said copending application, must comply with crash worthiness standards which are established by government agencies and automobile manufacturers. The objective of these standards is to assure that the latch and striker assembly will maintain the closure member in a closed position if the closure member is impacted from the inside. In accordance with these standards, the latch and striker assembly must be capable of withstanding a nominal 2500 lb. side load and a 3000 lb. axial load, relative to the direction of the striker pin.

It is, therefore, a primary object of the present invention to provide an improved final closing device for closure members on vehicles.

Another object of the present invention is to provide a cost-effective, final closing device for closure members on vehicles which device can reliably survive typical crash worthiness testing.

A further object of the invention is to provide an improved final closing device for closure members on vehicles in which a rotatable striker that is eccentrically mounted on a body member of the vehicle is precluded from reversely rotating, in order to prevent unintended opening of the closure member when high opening forces are applied thereto.

Additional objects and advantages of this invention will become apparent as the following description proceeds.

SUMMARY OF THE INVENTION

Briefly stated and in accordance with one embodiment of this invention, there is provided an improved final closing device for a closure member, which closure member is mounted for movement between open and closed positions on a vehicle body member and includes a latch bolt movable between latched and unlatched positions. The final closing device comprises a striker support plate mounted on the vehicle body member for rotational movement about an axis perpendicular to the striker support plate; a striker carried by the striker support plate and projecting therefrom at a position eccentrically offset from the axis; means carried by the vehicle body member and connected to the striker support plate for rotating the striker support plate; and means coupled to said rotating means and constructed and arranged to preclude reverse rotation of said striker plate for preventing unintended opening of the closure member when high opening forces are applied thereto. The striker is movable between extended and retracted positions upon unidirectional rotation of the striker support plate so that when the striker is in latching engagement with the latch bolt and the striker support plate is rotated, the closure member is moved between a partially opened position, away from the vehicle body member, and a fully closed position, in sealing engagement therewith.

BRIEF DESCRIPTION OF THE DRAWINGS

While the specification concludes with claims particularly pointing out and distinctly claiming the subject matter regarded as the invention herein, it is believed that the present invention will be more readily understood from the following description, taken in conjunction with the accompanying drawings, in which:

FIG. 4 is a partly diagrammatic sectional view, taken along the line 4—4 of FIG. 3, showing internal details of the final closing device, and showing the relationship of the door edge to a weather seal strip on the vehicle body, under various conditions of closure of the door;

FIG. 5 is a sectional view, with parts cut away for clarity, taken along the line 5—5 of FIG. 4;

DETAILED DESCRIPTION

Figure 1:
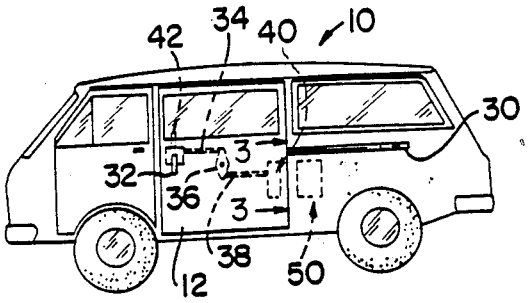
FIG. 1 is a diagrammatic, elevation view of a vehicle, in this case a van, in which the present invention is used to accomplish the final closing movement of a closure member comprising a sliding door.
Figure 2:
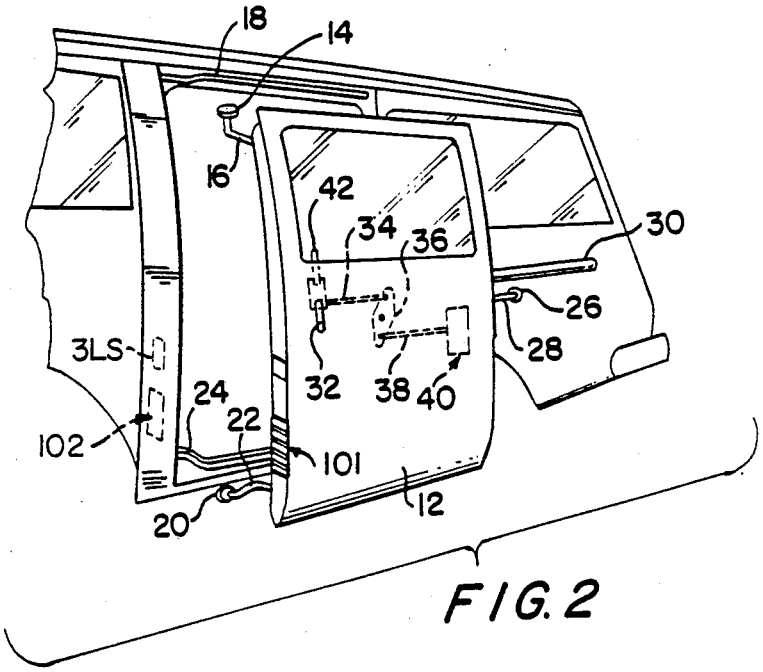
FIG. 2 is an enlarged, exploded view, with parts cut away for clarity, of the sliding door of FIG. 1, showing the manner in which the door is mounted for sliding movement relative to the vehicle body.

Referring to FIGS. 1 and 2, wherein the invention has been illustrated on a "van" type of vehicle 10 and is employed to accomplish the final closing movement of a closure member that in this instance comprises a sliding door 12, the arrangement of the sliding door 12 relative to the van 10 will first be briefly described.

The sliding door 12 is supported on the body of van 10 at three points. The first point of support comprises an upper roller 14 carried by an arm 16 that is fastened to the door 12. Roller 14 engages an upper guide rail 18 that is attached to the upper end of an open portion of the vehicle body that receives the door. The second point of attachment comprises a lower roller 20 carried by an arm 22 that is fastened to door 12. Roller 20 engages a lower guide r il 24 that is attached to the lower end of the open portion of the vehicle body. The third point of attachment comprise a mid-level roller 26 carried by an arm 28 that is fastened to the door 12 and engages a mid-level guide rail 30 attached to an outer body panel of the vehicle. The foregoing arrangement allows the slide door 12 to be slidably moved to and fro along the guide rails 18, 24 and 30.

The door 12 is provided with conventional inner (not shown) and outer handles 32 which are connected via a linkage arrangement including arm 34, cross link 36 and arm 38 to a conventional latch mechanism, shown generally at 40. A suitable internal locking arrangement, shown generally at 42 and an external key locking arrangement (not shown) are provided to prevent unauthorized entry into the vehicle.

Figure 3:
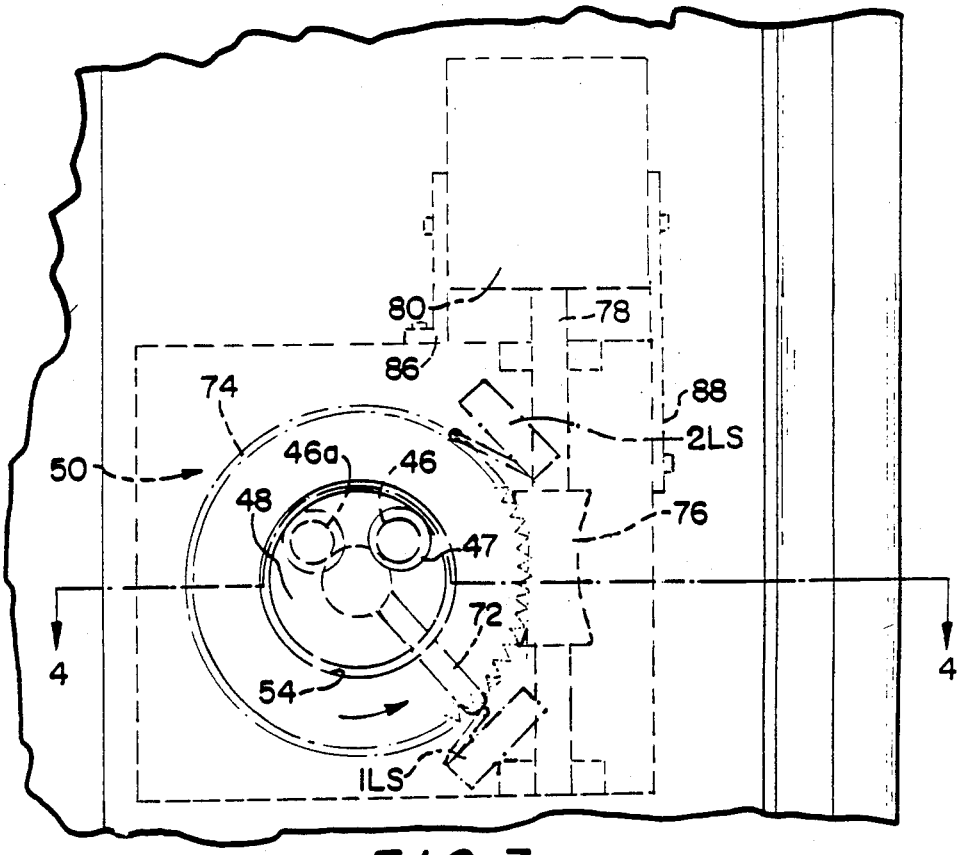
FIG. 3 is an elevation view, taken along the line 3—3 of FIG. 1, showing the striker and striker plate of the final closing device.
Figure 6:
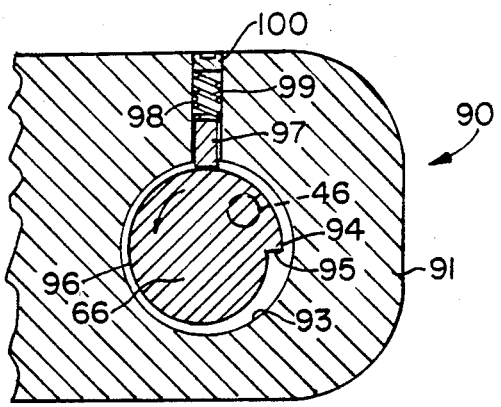
FIGS. 6–8 are enlarged sectional views, taken along the line 6—6 of FIG. 4, of a mechanism for precluding reverse rotation of the striker plate and showing the relationship of a pawl to a single tooth ratchet wheel thereof when the striker pin is in its extended position, its retracted position, and en route from its retracted position to its extended position, respectively.
Figure 7:
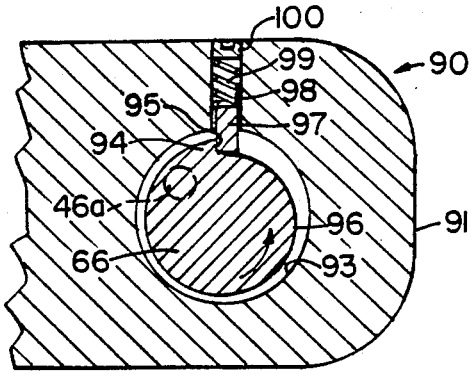
Figure 8:
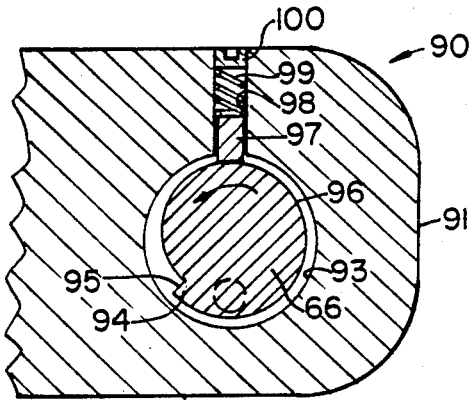
Figure 10:
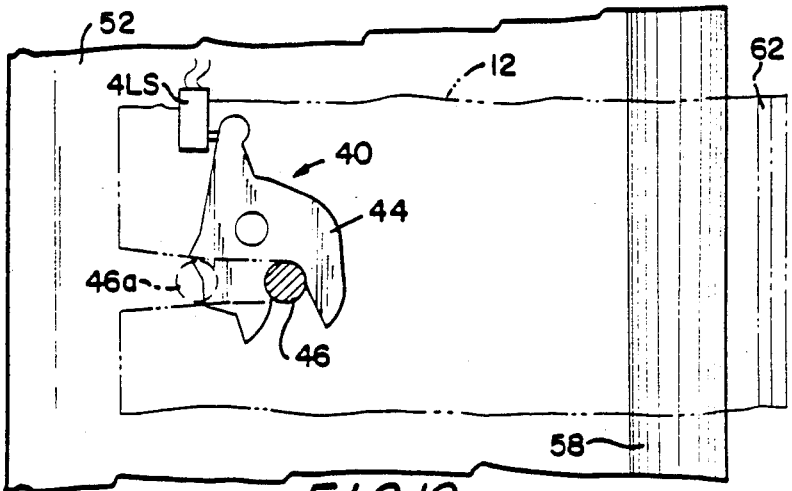

Referring to FIGS. 3, 4 and 10 in conjunction with FIG. 1, the door 12 is illustrated therein in its partially open position, ready for final closing. Latch mechanism 40 includes a latch bolt 44 which is at this time fully engaged with and latched on to a striker or striker pin 46 having an enlarged head 47 thereon capable of preventing the latch bolt 44 from axially pulling off of the striker pin during high impact axial loads of at least 3000 pounds that might occur in an automobile accident. The striker pin 46 is carried by and projects outwardly from a rotatable striker plate 48. The striker 46, striker head 47 and striker plate 48 form parts of a final closing device, shown generally at 50. Device 50 is fixedly mounted upon a body member 52 of vehicle 10 with its rotatable striker plate 48 positioned within an aperture 54 in body member 52 so that striker 46 is positioned in the path of movement of the latch member 44 on door 12.

Figure 11:
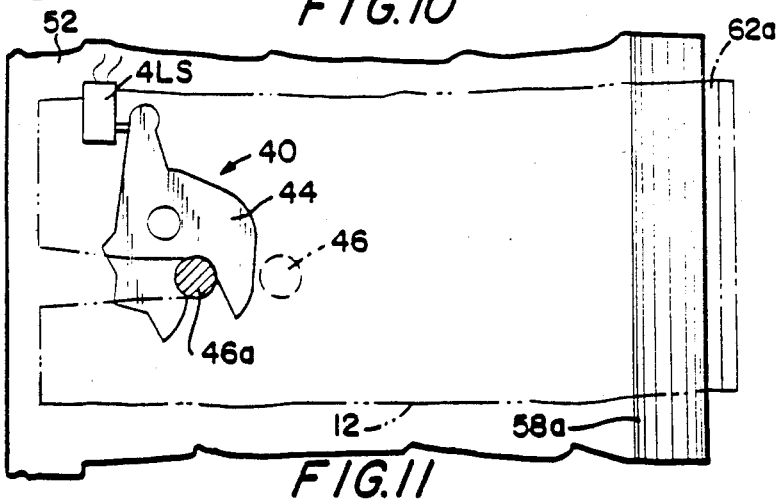

The body member 52 forms part of the frame of the opening for the door 12 and has fastened to it a panel member 56 which carries an elastomeric weather seal strip 58 on a flange 60 formed thereon. The weather seal strip 58 is adapted to be compressed by a marginal portion 62 of the door 12 when the door is finally closed. The marginal portion 62 of door 12 has been illustrated at 62*a* in FIGS. 4 and 11 to show the door in its finally closed position with the seal strip 58 compressed. The compressed condition of seal strip 58 has been illustrated by broken lines at 58*a* in FIG. 4. As illustrated at 62 in FIGS. 4 and 10, the door 12 is in its partially closed position, with the latch member 44 engaged and latched to the striker 46, and with the striker 46 at its extended position. The retracted position of striker 46 has been shown in broken lines at 46*a* in FIG. 4. The marginal portion 62 of door 12 is also shown in FIG. 4, in broken lines at 62*b*, to represent the position the marginal portion of the door would be in just prior to the engagement of latch 44 with striker 46. This condition of the door 12 and its marginal portion 62b has also been illustrated in FIG. 9.

Referring to FIGS. 3, 4 and 5, the final closing device 50 will now be considered in greater detail. Final closing device 50 includes a housing 64 which is bolted or otherwise fastened to body member 52. Housing 64 rotatably supports a shaft 66 in bearings 68, 70 carried in aligned openings 71, 71*a* of the housing 64. Shaft 66 has fixed to one of its ends striker plate 48 and carries an actuating arm 72 adjacent the other of its ends so that when shaft 66 rotates, striker plate 48 and actuating arm 72 rotate along with it. A shoulder 73 is provided in the opening 71 of housing 64 to prevent the bearing 70 from being pulled out of its opening 71 under the aforementioned high impact axial loads that might occur in an automobile accident. Shaft 66 has a pinion gear 74 keyed thereto. The pinion gear is driven by a worm gear 76 carried on the shaft 78 of a motor 80. Shaft 78 is supported in housing 64 by bearings 82, 84, and the motor 80 is fastened by brackets 86, 88 to housing 64.

It will thus be seen that when motor 80 is actuated to rotate pinion gear 74, shaft 66 and striker plate 48 are correspondingly rotated, carrying striker pin 46 from its solid line, extended, position shown at 46 in FIGS. 3 and 4 to its broken line, retracted, position shown at 46*a* in those figures. This, in turn, moves the marginal portion 62 of door 12 from its position shown at 62 in FIGS. 4 and 10 to its position shown at 62a in FIGS. 4 and 11.

As the striker pin moves from its extended position at 46 to its retracted position at 46*a* upon counter clockwise rotation (as viewed in FIG. 3) of the striker support plate 48, the striker pin makes a slight vertical motion relative to the vehicle frame. This vertical motion has no detrimental effect on the operation of door 12 because there is sufficient vertical play between the door and the frame and sufficient vertical clearance within the latch member 44 to accomodate this motion.

The extended and retracted positions of striker 46 are sensed by corresponding limit switches 1LS and 2LS, shown in FIG. 5. Limit switch 1LS includes a normally closed contact therein which is opened and held open by actuating arm 72 when the arm actuates limit switch 1LS, signifying that striker 46 has reached and is at its extended position. When striker 46 is moved to its retracted position, actuating arm 72 is moved away from limit switch 1LS and into actuating contact with limit switch 2LS. Limit switch 2LS includes a normally closed contact therein which is opened and held open by actuating arm 72 when the striker 46 reaches and is at its fully retracted position, at which position the door 12 is in its finally closed position compressing seal strip 58.

Referring to FIGS. 4 and 6–8, in order to prevent reverse rotation or back-driving of the striker plate when the fully closed door is impacted from the inside under high loads, for example the 2500 pound striker pin crash worthiness side load established by governmental agencies and automobile manufacturer's, a unidirectional lock, shown generally at 90, is coupled to the shaft 66 of the striker plate. The lock 90 includes a bracket 91 which is bolted by bolts 92 to the housing 64 and has an opening 93 therein through which one end of shaft 66 passes. Shaft 66 is machined at the portion thereof within the opening 93 so that a ratchet tooth 94 having a radially extending face 95 thereon is formed. The radially inner and outer ends of the face 95 are connected by a smooth spiral cam surface 96. A pawl 97, which is radially movable in an opening 98 formed in bracket 91, is biased against cam surface 96 by a spring 99. A threaded lock bolt 100, which threads into corresponding threads formed in the upper end of opening 98, preloads spring 99. The lower end of pawl 97, as viewed in FIGS. 6–8, rides on the spiral surface 96 of shaft 66, allowing the shaft to rotate counterclockwise as viewed in those figures. When the striker pin 46 is in its retracted position, as shown at 46a in FIG. 7, the pawl 97 moves into position abutting the radial face 95 of tooth 94 to positively lock the shaft 66 from reverse rotation. Thus, when the door of the vehicle has been finally closed, as signified by striker pin 46 being in its retracted position, shaft 66, striker plate 48 and striker pin 46 are locked against reverse rotation or back driving by the engagement of the pawl 97 with the radial face 95 of tooth 94.

Figure 9:
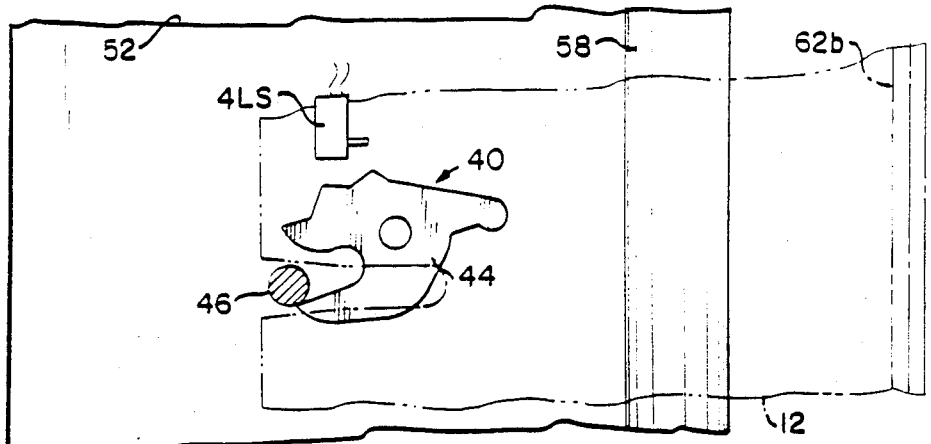
FIGS. 9–11 are diagrammatic elevation views, taken along the line 10—10 of FIG. 4, showing the relationship of the latch bolt and striker to the weather seal strip on the vehicle body, during various stages of closing of the sliding door; and, FIG. 12 is a circuit diagram of an electrical circuit that may be employed in controlling the operation of the final closing device.

Referring to FIGS. 2, 9, and 10, the limit switches associated with sliding door 12 and latch bolt 44 will now be considered. As shown in FIG. 2, sliding door 12 may be manually moved along guide rails 18, 24 and 30, between a nearly closed position and a fully open position. As door 12 approaches its nearly closed position (just before latch member 44 reaches striker pin 46) the front end surface of door 12 engages with and actuates a limit switch 3LS that is carried on the front end surface of the body opening for door 12. Limit switch 3LS is provided with a set of normally closed contacts which open when the limit switch is actuated as the door 12 approaches its nearly closed position.

The purpose of limit switch 3LS is to verify that the latch bolt 44 is in its fully unlatched position, as shown in FIG. 9. When latch bolt 44 is fully unlatched, the striker pin can be moved from its retracted position at 46*a*, shown in FIG. 11, to its extended position at 46, shown in FIG. 9, without obstruction from latch bolt 44. It is known from observing the operation of door 12 that the latch bolt 44 must be fully unlatched for the front end surface of the door to disengage from the front end surface of the body opening for the door. Thus, a closed contact in limit switch 31S is used to inform the electrical control system that the latch bolt 44 is fully unlatched and that the striker can be moved from the retracted position to the extended position without obstruction.

Latch bolt 44, which moves between its unlatched or open position, shown in FIG. 9, and its latched or closed position, shown in FIG. 10, actuates the contacts of a limit switch 4L when it arrives at its latched position. Limit switch 4LS is provided with a set of normally open contacts which close when the latch bolt moves to its latched position, shown in FIG. 10, engaging and latching on to striker 46. These contacts open when latch bolt 44 is moved to its unlatched position, shown in FIG. 9. Latch bolt 44 is moved to its unlatched position when the door handle 32 is moved from its closed to its open position. This is accomplished by the linkage assembly, shown in FIG. 1, comprising arm 34, cross link 36 and arm 38, which connects to the latch mechanism 40 in a conventional manner. The door handle 32 can, of course, be replaced by a key lock or other actuating mechanism (not shown) when the final closing device 50 is used in conjunction with another type of closure member (e.g. A trunk lid or a hingedly mounted door), rather than a sliding door.

Referring to FIG. 2, a plurality of spring-loaded movable contacts, shown generally at 101, are disposed on the front end surface of sliding door 12 and a plurality of corresponding fixed contacts, shown generally at 102, are disposed on the front end surface of the body opening for door 12. Contacts 101 and 102 interconnect the limit switch 4LS mounted on door 12 with the remainder of the electrical circuits which control final closing device 50. These contacts are closed when door 12 is being manually closed and nears its nearly closed position, at which the latch bolt 44 latches onto striker 46 and the final closing device 50 actuates to finally close the door. Contacts 101 and 102 remain closed during the time that door 12 is fully closed, and during the initial opening movement of door 12.

Figure 12:
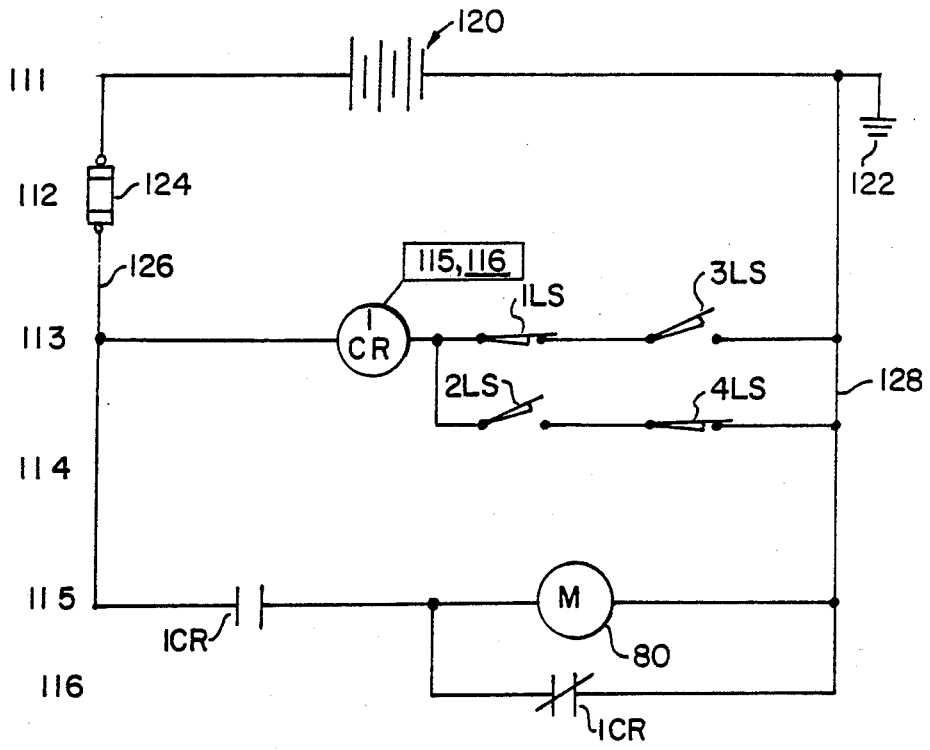

Referring now to FIG. 12, which comprises a circuit diagram of an electrical system that may be employed in controlling the final closing device 50, a line numbering system has been employed to facilitate the description of the electrical system. The line numbers have been listed on the left side of FIG. 11 and they run consecutively from line number 111 through line number 116. The line numbers on which the contacts of relays appear have been listed above and to the right of the relays they refer to an underlining is employed to indicate normally closed contacts. Thus, referring to FIG. 12, relay ICR (line 113) is provided with a set of normally open contacts positioned in line 115 and with a set of normally closed contacts positioned in line 116 (as indicated by these numbers being placed above and to the right of control relay 1CR).

The electrical control system for final closing device 50 includes a battery, shown generally at 120, one terminal of which is connected to ground at 122 and the other terminal of which is connected through a fuse 124 (line 112) to a conductor 126 which feeds power to the various components of the electrical control system. The components of the electrical control system have been illustrated in FIG. 12 in the conditions they assume when the sliding door 12 is in its fully closed condition. Thus, the normally closed contacts of limit switch 1LS in line 113 are closed (signifying that striker 46 is in a position other than its extended position); the normally closed contacts of limit switch 2LS in line 114 are open (signifying that striker 46 is fully retracted); the normally closed contacts of limit switch 3LS in line 113 are open; and, the normally open contacts of limit switch 4LS in line 114 ar closed (signifying that the latch bolt 44 is in its latched position in engagement with striker 46).

When the door handle 32 (FIG. 1) is opened, opening latch bolt 44, limit switch 4LS deactuates and its contacts in line 114 open, preconditioning line 114 to prevent energination of control relay lCR (line 113) via line 114. When the door 12 is manually moved away from its nearly closed position toward its open position, the contacts of limit switch 3LS in line 113 close, thus indicating that the latch bolt 44 is fully unlatched. Accordingly, control relay lCR (line 113) energizes via the closed contacts of limit switches ILS and 3LS in line 113, closing its contacts 1CR in line 115 and opening its contacts 1CR in line 116. When contacts 1CR in line 116 open, they remove ground potential from the input side of motor 80, which potential had previously been applied thereto from ground connection 122 via a conductor 128 and the normally closed contacts lCR in line 116. In addition, the aforementioned closing of contacts ICR in line 115 energizes motor 80 to rotate striker plate 48 in a counterclockwise direction (as viewed in FIG. 3). This moves the striker from its retracted position at **46*a* to its extended position at 46**.

When striker 46 starts rotating from its retracted position toward its extended position, limit switch 2LS deactuates, causing its contacts in line 114 to close, preconditioning control relay ICR for subsequent energization via that line. When the striker 46 has been rotated by motor 80 to the extended position shown in full lines in FIGS. 3 and 4, actuating arm 72 actuates limit switch 1LS, causing contacts ILS in line 113 to open and preconditioning line 113 to prevent subsequent energization of control relay lCR via that line. Thus, control relay ICR (line 113) is de-energized at this point. Contacts ICR in line 115 thus open, de-energizing motor 80, and contacts 1CR in line 116 close, grounding the input to motor 80 and dynamically braking it. At this point, the striker 46 is in position to be engaged by the latch bolt 44 when the door is subsequently closed.

When the door 12 is subsequently moved toward and into its nearly closed position, shown in FIG. 10, in connection with closing the door, limit switch 3LS initially actuates, opening its contacts in line 113 without effect, and then when the latch bolt 44 moves to its latched position in engagement with striker 46, limit switch 4LS actuates and its contacts in line 114 close, energizing control relay lCR (line 113) via the closed contacts of limit switches 2LS and 4LS in line 114.

Accordingly, contacts ICR in line 116 open and contacts lCR in line 115 close, energizing motor 80 for rotation in the same direction as in its previous rotation and causing striker 46 to be rotated from its extended position 46, shown in solid lines in FIGS. 3 and 4, to its retracted position 46a, shown in broken lines in FIGS. 3 and 4. As a result, door 12 is moved from its nearly closed position to its finally closed position, at which the marginal portion 62 compresses the seal 58, as shown at **62*a* and 58*a* in FIGS. 4 and 11. The initial movement of striker 4 toward its retracted position results in the deactuation of limit switch ILS and the closing of its contacts in line 113, without further effect. When striker 46 arrives at its retracted position, limit switch 2LS (FIG. 5) is actuated and its contacts in line 114 open, de-energizing control relay ICR in line 113. Contacts ICR in line 115 thus open, de-energizing motor 80, and contacts lCR in line 116 close, grounding the input to motor 80 and dynamically braking it. At this point, the components of the electrical control system have been returned to the conditions they were in at the start of this discussion of the electrical circuits of FIG. 12. The electrical control system is thus awaiting subsequent opening of the door handle 32** and opening movement of the door to initiate another operating cycle of the system.

From the foregoing description, it can be seen that the present invention provides an improved final closing device for vehicle closure members, which device can reliably survive typical crash worthiness testing and in which device an eccentrically mounted, motor driven striker, carried on the vehicle body member is employed to finally close the closure member with high force against the resistance of the weather seal strip carried by the vehicle body. The resulting final closing device is economical, sturdy in construction, reliable in operation, and can be retrofitted onto vehicles that were not originally designed to receive such a device.

While there has been shown and described what is presently considered to be the preferred embodiment of this invention, it will be obvious to those skilled in the art that various changes and modifications may be made without departing from the broader aspects of this invention. It is, therefore, aimed in the appended claims to cover all such changes and modifications as fall within the true spirit and scope of this invention.

What is claimed is:

1. A final closing device for a closure member, which closure member is mounted for movement between open and closed positions on a vehicle body member and includes a latch bolt movable between latched and unlatched positions, said device comprising a striker support plate mounted on said body member for unidirectional rotational movement about an axis perpendicular to said plate, a striker carried by said striker support plate and projecting therefrom at a position eccentrically offset from said axis, means carried by said body member and connected to said striker support plate for rotating said striker support plate, and means coupled to said rotating means and constructed and arranged to preclude reverse rotation of said striker plate for preventing unintended opening of the closure member when high opening forces are applied thereto, said striker being movable between extended and retracted positions upon rotation of said striker support plate so that when said striker is in latching engagement with said latch bolt and said striker support plate is rotated, said closure member is moved between a partially open position, away from said body member, and a fully closed position, in sealing engagement therewith.

2. A final closing device according to claim 1, wherein said means for preventing unintended opening of the closure member includes a ratchet member and a pawl member, one of said ratchet and pawl members being carried by said body member and the other of said ratchet and pawl members being carried by said rotating means.

3. A final closing device according to claim 2, wherein said ratchet member comprises a toothed wheel carried by said rotating means, and wherein said pawl member is slidably carried by said body member and is spring-biased toward said toothed wheel.

4. A final closing device according to any one of claims 1, 2 or 3 and further including a housing for attaching said device to said vehicle body member, said striker support plate rotating means comprising a shaft member rotatably carried by said housing, said shaft member being coaxial with said axis and carrying said striker support plate at one end therereof, a driven gear member mounted upon said shaft member and keyed thereto within said housing, a driving gear member rotatably supported within said housing and coupled to said driven gear member, and a motor supported by said housing and drivingly onnected to said driving gear member.

5. A final closing device according to any one of claims 1, 2 or 3, and further including circuit means connected to said striker support plate rotating means for controlling operation of said device, said circuit means including switch means responsive to said latch bolt being in its latched position and said striker being in other than its retracted position for actuating said striker support plate rotating means to move said striker to its retracted position.

6. A final closing device according to claim 5, wherein said switch means is further responsive to said striker arriving at its retracted position for deactuating said striker support plate rotating means when said striker reaches said retracted position.

7. A final closing device according to claim 5, wherein said switch means is further responsive to the position of said closure member and actuates said striker support plate rotating means to move said striker to its extended position when said closure member is moved to other than its fully closed position while said striker is in a position that is other than its extended position.

8. A final closing device according to claim 7, wherein said switch means deactuates said rotating means when said striker reaches its extended position.

9. A final closing device according to claim 5, wherein said switch mean is further responsive to said closure member being in its nearly closed position before actuating said striker plate rotating means to move said striker to its retracted position.

10. A final closing device according to claim 9, wherein said switch means is further responsive to said striker arriving at its retracted position of deactuating said striker support plate rotating means when said striker reaches said retracted position.

* * * * *